US005551187A

United States Patent [19]

Brouwer et al.

[11] Patent Number: 5,551,187

[45] Date of Patent: Sep. 3, 1996

[54] RELEASE MECHANISM FOR A DOOR SPRING

[76] Inventors: Nicolaas D. Brouwer, Johannes Elsevierlaan 32, 3771 KT Barneveld; Petrus A. Besselink, Gronausestraat 1220, 7534 AT Enschede, both of Netherlands

[21] Appl. No.: 208,654

[22] Filed: Mar. 9, 1994

[30] Foreign Application Priority Data

Oct. 3, 1993 [NL] Netherlands ..... 9300434

[51] Int. Cl.[6] ..... E05F 15/20

[52] U.S. Cl. ..... 49/1; 292/DIG. 66

[58] Field of Search ..... 49/1, 2, 379; 16/48.5; 292/DIG. 66, 92, 21; 220/201; 337/300, 315, 314, 388, 393

[56] References Cited

U.S. PATENT DOCUMENTS

| | | | |
|---|---|---|---|
| 3,063,086 | 11/1962 | Calhoun . | |
| 3,082,306 | 3/1963 | Howard | 337/388 |
| 3,705,739 | 12/1972 | Adler | 49/1 X |
| 3,771,823 | 11/1973 | Schnarr . | |
| 3,964,125 | 6/1976 | Tansley | 49/1 X |
| 4,161,804 | 7/1979 | D'Hooge et al. | 292/DIG. 66 |
| 4,675,642 | 6/1987 | Reifeescheid | 337/393 X |
| 5,121,950 | 6/1992 | Davidian | 292/DIG. 66 |

FOREIGN PATENT DOCUMENTS

| | | | |
|---|---|---|---|
| 3638208 | 5/1988 | Germany . | |
| 99542 | 7/1980 | Japan | 220/201 |
| 1554738 | 10/1979 | United Kingdom . | |
| 2203646 | 10/1988 | United Kingdom . | |

*Primary Examiner*—Jerry Redman

*Attorney, Agent, or Firm*—Killworth, Gottman, Hagan & Schaeff

[57] ABSTRACT

Release mechanism for releasing a door-spring blocked by a blocking device, which mechanism comprises a temperature-sensitive control element for direct thermal actuation, by means of which the mechanism intervenes in the blocking device at a predetermined temperature of that element such that the door-spring is released. The release mechanism comprises for instance a rod guided for movement in longitudinal direction between a first end position and a second end position under a first bias in the direction to this first end position, and a control element comprising an SME material which at the predetermined temperature encloses the rod under a second bias greater than the first and in opposite direction thereto, which rod is coupled to a control member of the blocking device, which control member keeps the blocking device in operation in the first end position of the rod and renders the blocking device inoperative in the second end position of the rod. The release mechanism may further comprise a control circuit.

25 Claims, 3 Drawing Sheets

RELEASE MECHANISM FOR A DOOR SPRING

FIELD OF THE INVENTION

The invention relates to a release mechanism for releasing a door-dash spring blocked by a blocking device.

BACKGROUND OF THE INVENTION

A door-spring is often provided in a known manner with a blocking device, which is used to counter the force exerted by a door-spring and secure a door open. By applying a blocking device on a door provided with a door-spring, it is possible to hold a door in an opened position for a longer time without human intervention. A known blocking device is, for instance, constructed such that a door-spring blocked by this device can be released by human intervention. This human intervention includes, for instance, applying a small force to a blocked door in the direction in which the door is carried from an opened to a closed position.

A known release mechanism of the type referred to above can also be activated automatically, that is, without human intervention. Such a release mechanism is coupled, for instance, to a smoke detector and is applied, for example, in combination with the door-springs of doors which are closed automatically in the case of a smoke and/or fire alarm.

A release mechanism disclosed in U.S. Pat. No. 3,371,823 includes, for instance, the combination of a blocking device and an electromagnet. In the situation where the blocking device blocks a door-spring, the electromagnet is energized and actuates a biased control member of this blocking device. When the current which energizes the electromagnet falls away, the control member can be displaced by the exerted bias.

Such a release mechanism has a number of drawbacks. The release mechanism cannot be used without a control circuit for supplying the current for the electromagnet. The power consumption of such a combination is comparatively high which is undesirable, particularly in large buildings with a large number of doors provided with such a release mechanism.

SUMMARY OF THE INVENTION

It is an object of the invention to provide a release mechanism which does not have the drawbacks of the prior art.

This object is achieved by providing a release mechanism which comprises a temperature-sensitive control element operatively adapted for direct thermal actuation and for thereby enabling the release mechanism to intervene in the operation of a blocking device, at a predetermined temperature of the control element, to release a door spring.

A release mechanism according to the invention is activated at a predetermined temperature without the need of a control circuit, coupled to the release mechanism, generating a signal for this purpose.

In one embodiment, a release mechanism according to the invention comprises a rod guided for movement in a longitudinal direction between a first end position and a second end position. The rod is moved in the direction of this first end position by an applied first bias. A control element made with a shape memory effect (SME) material is operatively adapted, at the predetermined temperature, to apply a second bias greater than the first bias to move the rod in the opposite direction toward the second end position. The rod is coupled to a control member which is operatively adapted to keep the blocking device in position to block a door when the rod is at the first end position and to render the blocking device inoperative when the rod is at the second end position.

In an embodiment of a release mechanism which is particularly suitable for use with a mechanical door-spring, the rod is coupled to the control member via a carrier element, and the control member is moveable in an axial direction relative to the rod through a distance determined by the dimensions of the carrier element.

In an embodiment of a release mechanism particularly suitable for a hydraulic door-spring, the rod is coupled to a closing plunger disposed in a bypass line between two compartments of a hydraulic cylinder, where the two compartments are separated by a piston connected to a door-spring.

The first bias applied to move the rod in a lengthwise direction toward the first end position is, for instance, provided by a first spring and the second bias for countering the first bias and moving the rod toward the second end position is supplied, for instance, by a member made with a SME material which assumes the form of a spring above the transformation temperature of that material.

When the release mechanism is used with a fire door, the transformation temperature of the SME material can, for instance, be reached through a rise in temperature resulting from fire in the direct vicinity of this door. The temperature increase of the SME material can also be realized by using a heating element which is switched on remotely and is in thermal contact with the SME material. This heating element is then, for instance, coupled in a known manner to a control circuit which can remotely switch on the heating element in response to a determined input signal of this control circuit. A release mechanism according to the invention which is provided with such a heating element, which can be switched on remotely, can thus be activated on the one hand by a temperature increase in the immediate vicinity of that release mechanism and on the other hand by a temperature increase of the heating element which is initiated by the control circuit coupled to the heating element.

A release mechanism according to the invention which is provided with a rod guided for movement in a lengthwise direction preferably includes a sensor for sensing the position of this rod.

By using such a sensor, it can be determined in a simple manner that the rod is guided from the first to the second end position and the release mechanism has, as a result, released a blocked door-spring. When a release mechanism according to the invention is, for instance, also provided with a heating element which can be switched on remotely by a control circuit, the remote switch-on of the heating element and the response of the release mechanism thereto is detected by the position sensor and can thus be determined and recorded in a simple manner.

A release mechanism according to the invention provided with a moveable and guided rod preferably includes structure for locking the rod in the second end position.

Once the blocked door-spring has been released, a release mechanism provided with such locking structure continues to hold the door-spring in its released position until the structure for locking the rod in the second end position has been disengaged from that position. Once a blocked door has been released by such a release mechanism, re-blocking of the door is only possible after an in situ human operation and inspection. The use of such a release mechanism for a fire door has advantageous safety aspects.

A release mechanism provided with a moveable and guided rod, in which the rod is coupled to a control member via a carrier element, preferably includes a transverse pin that is connected to the carrier element and protrudes through a slotted hole extending in a lengthwise direction in a guide element. A leaf spring is placed over the slotted hole and presses on the pin when the rod is situated between the first and second end position. The leaf spring falls behind the pin when the rod is situated in the second end position so as to lock the rod in the second end position.

Such an embodiment of the invention can be constructed in a simple manner, while its operation remains extremely reliable even after prolonged use.

The invention also relates to a control circuit for a release mechanism which is provided according to the invention with a rod guided for movement in a lengthwise direction, a heating element which can be switched on remotely and is in thermal contact with a control element made with a SME material, and a sensor for sensing the position of the rod. According to the invention, the control circuit comprises a power supply input, at least one first signal input for coupling to the position sensor, at least one second signal input for coupling to a second sensor and at least one current output for coupling to the heating element. Under operating conditions, the at least one output and inputs co-act such that, at a predetermined sensor signal to the second signal input, the current output supplies a current through the heating element for a period determined by a sensor signal transmitted to the first signal input.

Such a control circuit offers the advantage that it can be used in a simple manner and separately, in each case, in combination with one release mechanism per door-spring. Such a "stand-alone" application is possible because the heating element only has to be energized when releasing a door-spring. For this purpose a very small current is required for a very short period of time. Usually, in combinations of a release mechanism and a control circuit, a coil in the release mechanism has to be energized continuously.

In an embodiment of a control circuit according to the invention, the second signal input can be coupled to a temperature sensor. This temperature sensor is, for example, another member made with a SME material which can be arranged at a location in a building other than that of the relevant door-spring so that a dual safety system is obtained.

In a following embodiment, the second signal input of the control circuit can be coupled according to the invention to a second sensor which contains a circuit for measuring an increase in temperature per unit of time (dt/dt).

In the case of a rapid temperature increase at the position of the second sensor, it is possible to activate a release mechanism using such a circuit, even before the absolute temperature at the location of this sensor has reached a determined threshold value.

In a following embodiment, the second signal input of the control circuit can be coupled according to the invention to a smoke detector.

It has been found that current consumption of the heating elements is exceptionally low. For example, a current of 0.6 A for 30 sec., which corresponds to 5 mAh, can suffice. With a 6 V battery which can supply for instance 500 mAh, a blocking device can therefor be released according to the invention about 100 times. For safety reasons, a control circuit fed according to the invention by a battery is preferably provided with a battery voltage indicator which activates an optical, or optionally an acoustic, signal when the battery voltage reaches a predetermined threshold value.

More preferably, a battery powered control circuit comprises a battery voltage indicator which initiates an output current through a heating element coupled to this control circuit, when the battery voltage reaches a predetermined threshold value. When the release mechanism according to the invention is provided with structure for locking the rod in the second end position, a door-spring released as a result can then no longer be blocked until the relevant battery is replaced and the locking structure at that position has then been disengaged.

The invention will be further elucidated in the following description on the basis of embodiments, with reference to the drawings.

DETAILED DESCRIPTION OF THE INVENTION

Figure 1:
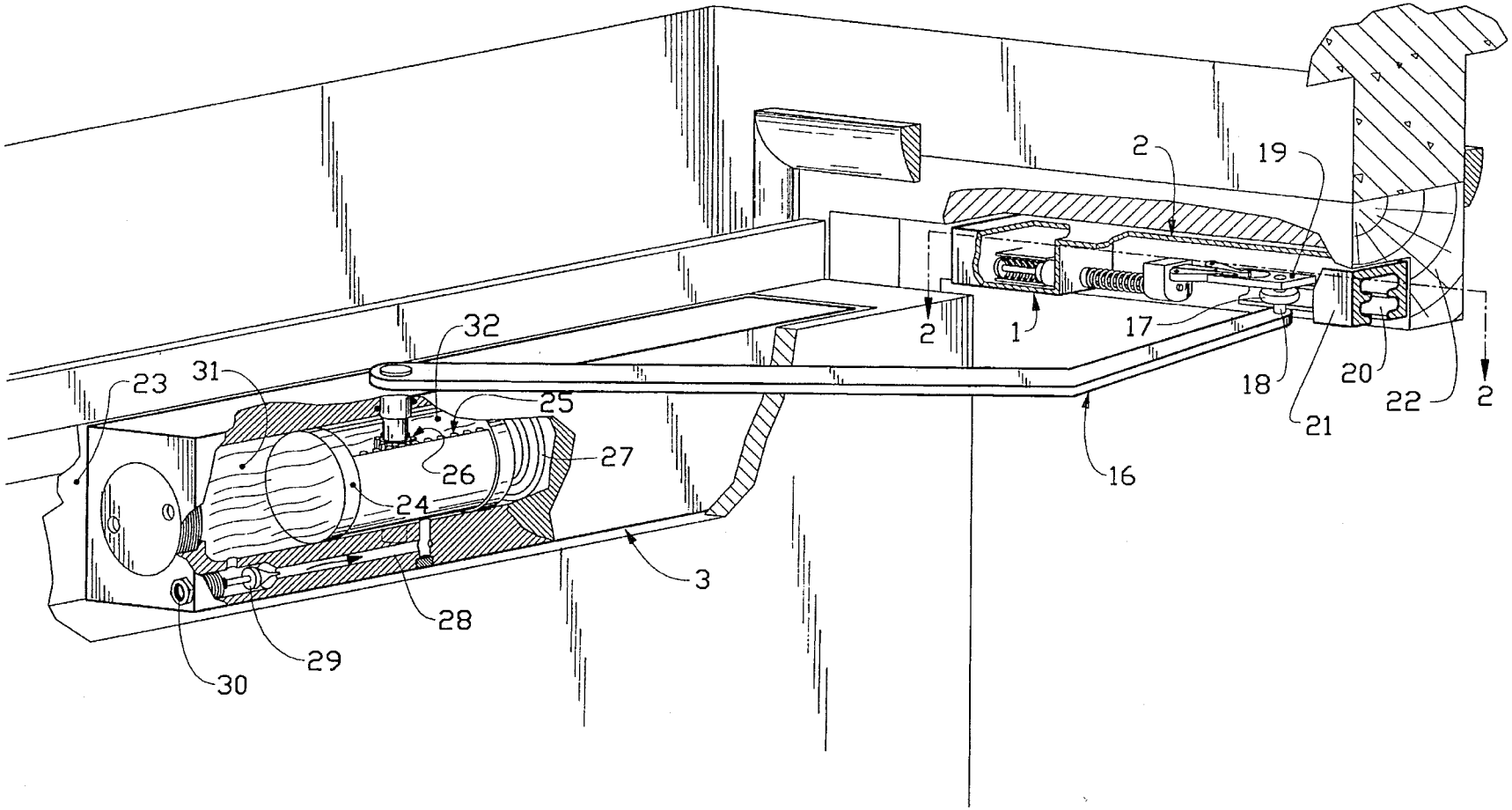
FIG. 1 is a perspective view of a door and a door-spring, with a blocking device and a release mechanism.

FIG. 1 shows in perspective view an opened door 23 provided with a door-spring 3 which is connected via an arm 16, a shaft 18 and a wheel 17 to a guide rail 20 received in a housing 21. Housing 21 is fixed to a door post 22 and comprises, in addition to guide rail 20, a blocking device 2, which co-acts with a coupling part 19 connected to shaft 18, and a release mechanism 1. The door-spring 3 in FIG. 1 comprises a hydraulically damped pressure spring 27 which co-acts with the pinion 26 of arm 16 via a piston rod (not shown) and a rack 25 connected thereto. FIG. 1 shows the door in the blocked situation. After release, the piston 24 is pressed to the left under influence of the spring 27, wherein the oil in the piston compartment 31 to the left of piston 24 is pressed via the bypass line 28 to the piston compartment 32 to the right of piston 24, which results in a damping of the movement of the door caused by the pressure spring 27. The degree of damping can be adjusted in a known manner using adjusting screw 30, by closing bypass line 28 to a greater or lesser extent with the adjusting plunger 29.

Figure 2:
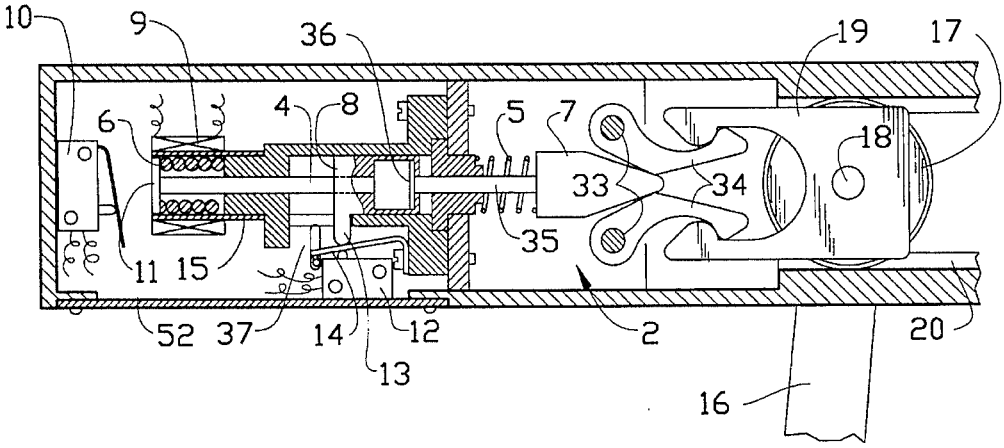
FIG. 2 is a top view of the release mechanism and the blocking device of FIG. 1 taken along line II—II, wherein the door-spring is blocked.

FIG. 2 shows a cross section through housing 21 on the plane through the line II—II of FIG. 1. The figure shows how the arm 16 of the door-spring (not shown) is held fixedly by blocking device 2 via shaft 18 and coupling part 19. This blocking device 2 comprises a system of hooks 34 pivoting on shafts 33 which lock coupling part 19, when these hooks 34 are pressed apart by control member 7. The latter is held by a first spring 5 in a first end position (corresponding with a position furthest to the right, as shown in the figure). A door blocked as according to FIG. 2 can be released-manually in a simple manner by exerting a force on the door in the direction of the closed position, which corresponds to exerting a force on coupling part 19 to the right in FIG. 2. This force is sufficient to cause the two hooks 34 to pivot toward one another on the shafts 33, wherein the control member 7 is pressed rearward and counter to the spring force of the first spring 5. Control member 7 is coupled via a rod 35 and a disc 36 on the end thereof to a cylindrical carrier element 8, wherein the disc 36 is freely movable over the length of this cylinder form. Rigidly coupled to carrier element 8 is a rod 4 of the release mechanism 1, which rod is enclosed for movement in a lengthwise direction in rod guide 15, in a first end position and under a first bias provided by first spring 5. Wound around the outer end of rod 4 that is not connected to the carrier element 8 is a control element 6 made of a shape memory effect (SME) material, which above a predetermined temperature, assumes the form of a spring. The control element 6 is bound on one side by a disc 11 attached to the end of the rod 4 and on the other side by the rod guide 15. The figure further shows a heating element 9 around the control element 6 and sensors 10 and 12. A pin 13 is connected to carrier element 8 and protrudes transversely through a lengthwise extending slotted hole 37 in the housing 38 for carrier element 8, and a leaf spring 14 is placed over slotted hole 37.

Figure 3:
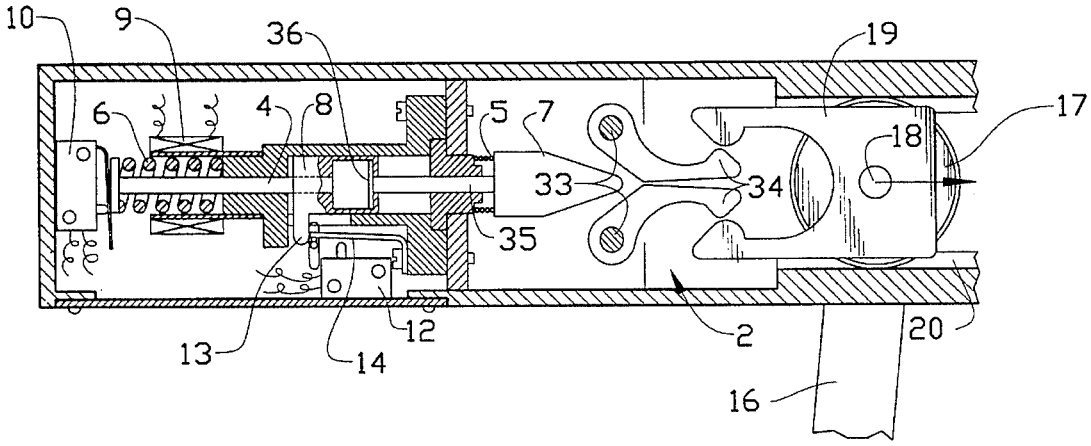
FIG. 3 is a top view of the release mechanism and blocking device of FIG. 2, now in the released situation.

The operation of the release mechanism of FIG. 2 will now be explained with concurrent discussion of FIG. 3, which shows the device of FIG. 2 with the rod 4 in the second end position.

When the temperature at the position of control element 6 of FIG. 2 rises above a determined value, for instance because a current is transmitted through heating element 9, the control element 6 will assume the form of a second spring which exerts a greater spring force than the first spring 5. Under the resultant force of the second spring 6 and the first spring 5 the rod 4 and the carrier element 8 connected thereto will move to the left in the figure, wherein carrier element 8 carries along the rod 35 and the control member 7 connected thereto. As a result, the hooks 34 can pivot toward one another on the shafts 33, which will also occur via movement of the coupling part 19 under influence of the force exerted by the door-spring in the direction of the arrow. Wheel 17 is herein guided along the guide rail 20. When rod 4 has reached its second end position is detected by sensor 10, in this case a microswitch which is actuated by the disc 11 on the end of rod 4. Using microswitch 10, the current through heating element 9, for instance, can be switched off. Rod 4 and the parts connected thereto are locked in the second end position by the leaf spring 14 such that leaf spring 14 falls against the pin 13 protruding through slotted hole 37 and when rod 4 is not in the second end position, and falls behind pin 13 when rod 4 is in the second end position, as shown in FIG. 3. Leaf spring 14 can further be utilized to operate a position sensor 12, in this embodiment a microswitch. This microswitch 12 then takes over the function of microswitch 10. As long as leaf spring 14 occupies the position shown in FIG. 3 it is not possible to block a door-spring using blocking device 2. Control member 7 for the blocking device 2 can only be released after the leaf spring 14, which is accessible via a covered opening 52 in housing 21, has been placed by human intervention in the position shown in FIG. 2. When the release mechanism is used in fire doors, for instance, once the fire doors have been released as a result of a current through the heating element 9 coming from a fire alarm, the blocking device 2 prevents the fire doors from being blocked again without previous in situ human inspection and intervention.

Figure 4:
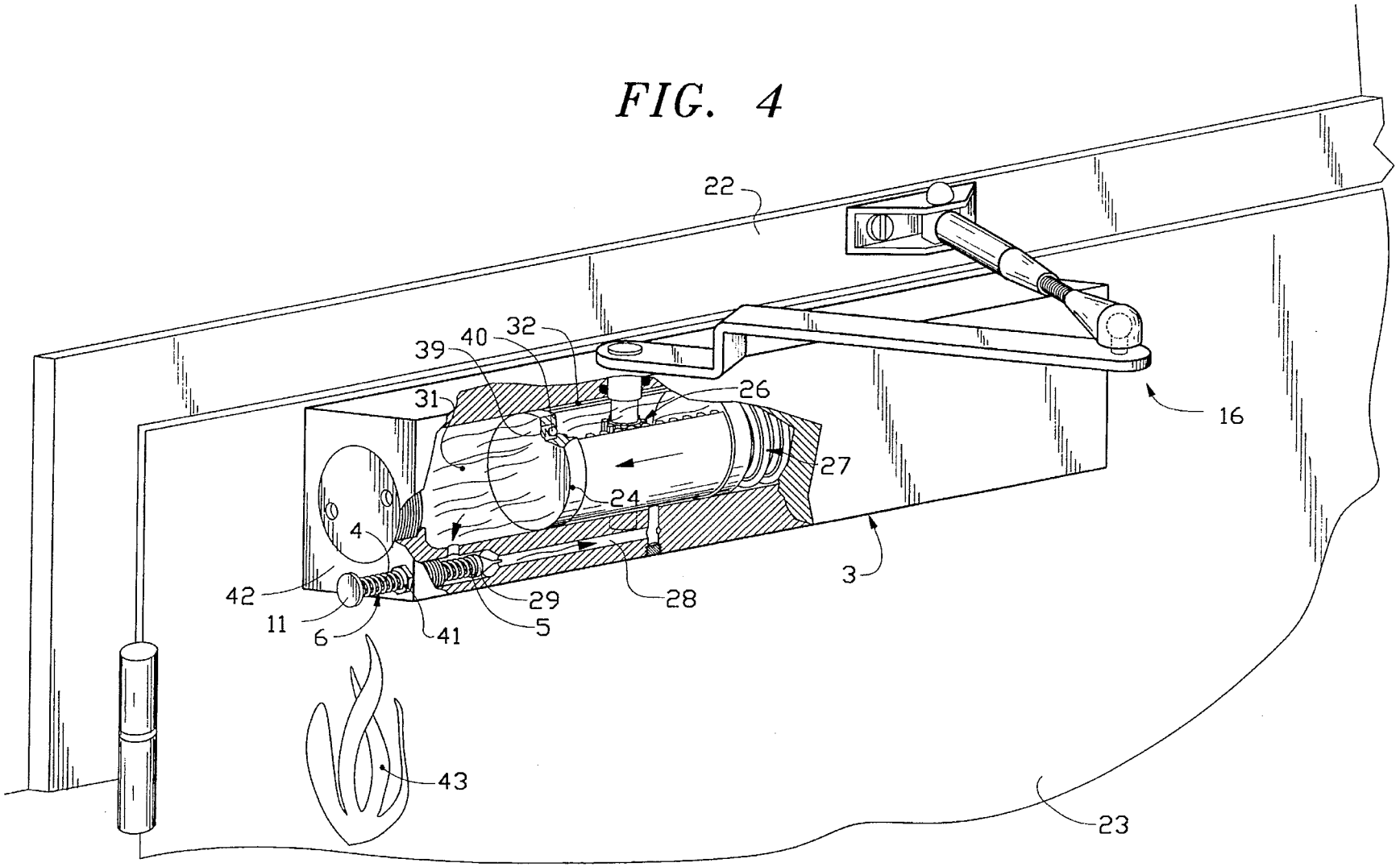
FIG. 4 is a perspective view of a door with a hydraulic door-spring provided with a blocking device and a release mechanism according to the invention.

FIG. 4 shows a hydraulic door-spring 3 provided with a release mechanism according to the invention. Door-spring 3 is fixed to a door 23, and connected via an arm 16 to a door post 22. Door 3 is drawn in the closed situation. Door-spring 3 operates, just as the door-spring depicted in FIG. 1, by means of a hydraulically damped spring 27. The blocking device of door-spring 3 consists of an adjusting plunger 29 which is held under a bias provided by a first spring 5 and which wholly closes the oil bypass line 28. When the door is opened, the piston 24 will be moved to the right, as a result of which the oil flows in through-the bypass line 28 in a direction opposite to that of the shown arrow, and will force away the adjusting plunger 29 counter to the spring tension provided by spring 5. An open door is blocked under normal conditions because the spring 5 presses the adjusting plunger 29 entirely into the bypass line 28. The door can be closed manually by pushing it lightly, wherein the oil flows from cylinder compartment 31 to cylinder compartment 32 via channel 39 in piston 24 counter to the spring pressure with which a closing valve 40 is pressed on channel 39. The rod 4 connected to adjusting plunger 29 protrudes via an oil-tight passage 41 outside the head end surface 42 of door-spring 3. Received between a disc 11 on the end of rod 4 and the head end surface 42 of door-spring 3 is a control element 6 made of SME material which, when heated above a determined temperature, assumes the form of a second spring with a greater spring tension than the spring tension of the first spring 5. When the temperature of the SME material of control element 6 rises above the transition temperature, for example as a result of a fire (designated symbolically with flames 43), the adjusting plunger 29 will be pressed away out of bypass line 28 as a consequence of the resultant spring force exerted by springs 6 and 5 so that the oil can flow freely from the first cylinder compartment 31 to the second cylinder compartment 32. The door 23 is thus released and will be closed under the influence of the spring pressure exerted by spring 27. The release-mechanism can be coupled in a simple manner to a control circuit when it is provided with a heating element which can be switched on remotely and is in thermal contact with control element 6.

Figure 5:
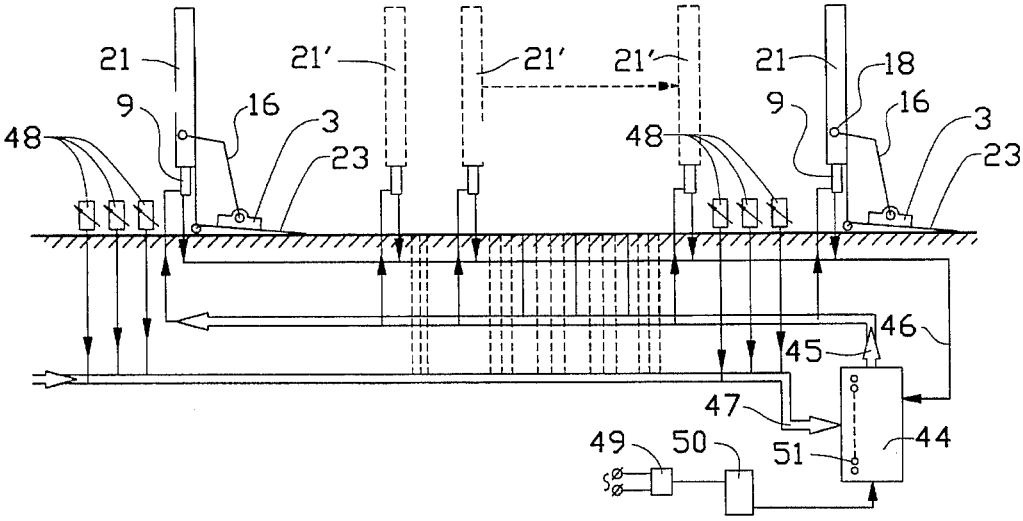
FIG. 5 is a schematic view of a system of release mechanisms coupled according to the invention to a control circuit.

FIG. 5 shows schematically two doors 23, each provided with a door-spring 3 which is coupled via an arm 16 to a blocking device provided with a release mechanism and indicated symbolically by housing 21. The release mechanism is of the type shown in FIGS. 1–3, provided with a heating element 9. These heating elements 9 can be actuated by an output current 45 of a central control circuit 44 which is coupled to smoke detectors 48 via signal lines 47. Circuit 44 can be adapted subject to the relevant application such that at an input signal 47 of a determined smoke detector 48, one or more doors 23 are released by actuation of the relevant heating element 9 for a period determined by the time duration between reception of the input signal 47 of the smoke detector 48 and the reception of input signal 46 of the position detector of the relevant release mechanism. The signal 46 can further be used to actuate an indicator lamp 51 which indicates which of the doors 23 is released. Control circuit 44 can be fed from the lighting circuit or by an emergency power unit via transformer 49 and rectifier 50, but can also be provided with a battery. As designated schematically with dashed lines, a plurality of blocking devices provided with a release mechanism can be coupled to a control circuit.

We claim:

1. A release mechanism for releasing a door-spring blocked by a blocking device when a temperature is reached, said release mechanism comprising:

a temperature-sensitive control element made with a shape memory effect material and operatively adapted for direct thermal actuation and thereby enabling said release mechanism to intervene in a operation of the blocking device to release the door-spring when said control element is at the temperature;

a rod guided for movement in a longitudinal direction between a first end position and a second end position, said rod being moved in the direction of said first end position by a first bias, and said control element being operatively adapted to apply a second bias greater than said bias to move said rod in an opposite direction thereto; and a control member actuated by movement of said rod and operatively adapted to keep the blocking device in operation when said rod is in said first end position and to render the blocking device inoperative when said rod is in said second end position.

2. The release mechanism as recited in claim 1, wherein said rod is coupled to said control member via a carrier element and said control member is movable in an axial direction relative to said rod through a distance determined by the dimensions of said carrier element.

3. The release mechanism as recited in claim 2, wherein said release mechanism further comprises a transverse pin connected to said carrier element and protruding through a slotted hole extending in a lengthwise direction in a guide element, and a leaf spring which is placed over said slotted hole, said leaf spring presses on said pin when said rod is situated between said first and second end position, and said leaf spring falls behind said pin when said rod is situated in said second end position so as to lock said rod in said second end position.

4. The release mechanism as recited in claim 2, wherein said release mechanism further comprises a heating element which can be switched on remotely and which is in thermal contact with said shape memory effect material.

5. The release mechanism as recited in claim 2, wherein said release mechanism further comprises a sensor for sensing the position of said rod.

6. The release mechanism as recited in claim 2, wherein said release mechanism further comprises structure for locking said rod in said second end position.

7. The release mechanism as recited in claim 1, wherein said rod is coupled to a closing plunger disposed in a bypass line between two compartments of a hydraulic cylinder, said compartments being separated by a piston connectable to a door-spring.

8. The release mechanism as recited in claim 7, wherein said release mechanism further comprises a heating element which can be switched on remotely and which is in thermal contact with said shape memory effect material.

9. The release mechanism as recited in claim 7, wherein said release mechanism further comprises a sensor for sensing the position of said rod.

10. The release mechanism as recited in claim 7, wherein said release mechanism further comprises structure for locking said rod in said second end position.

11. The release mechanism as recited in claim 1, wherein said first bias is provided by a first spring and said second bias is supplied by said control element which assumes the form of a second spring above the transformation temperature of said shape memory effect material.

12. The release mechanism as recited in claim 11, wherein said release mechanism further comprises a heating element which can be switched on remotely and which is in thermal contact with said shape memory effect material.

13. The release mechanism as recited in claim 11, wherein said release mechanism further comprises a sensor for sensing the position of said rod.

14. The release mechanism as recited in claim 11, wherein said release mechanism further comprises structure for locking said rod in said second end position.

15. The release mechanism as recited in claim 1, wherein said release mechanism further comprises a heating element which can be switched on remotely and which is in thermal contact with said shape memory effect material.

16. A control circuit for a release mechanism as claimed in claim 15 comprising a power supply input, at least a first signal input, at least a second signal input adapted for being coupled to a sensor, and at least a current output adapted for being coupled to said heating element, said inputs and said output co-act under operating conditions such that, at a sensor signal to said second signal input, said current output supplies a current through said heating element for a period determined by a signal to said first signal input.

17. The control circuit as recited in claim 16, wherein said second signal input can be coupled to a temperature sensor.

18. The control circuit as recited in claim 16, wherein said second signal input can be coupled to a sensor which comprises a circuit for measuring a temperature increase per unit of time.

19. The control circuit as recited in claim 16, wherein said second signal input can be coupled to a smoke detector.

20. The release mechanism as recited in claim 15, wherein said release mechanism further comprises a sensor for sensing the position of said rod.

21. The release mechanism as recited in claim 15, wherein said release mechanism further comprises structure for locking said rod in said second end position.

22. The release mechanism as recited in claim 1, wherein said release mechanism further comprises a position sensor for sensing the position of said rod.

23. The release mechanism as recited in claim 22, wherein said release mechanism further comprises structure for locking said rod in said second end position.

24. A control circuit for a release mechanism as claimed in claim 22 comprising:

a power supply input, at least a first signal input adapted for being coupled to said position sensor, at least a second signal input adapted for being coupled to a second sensor, and at least a current output for coupling to said heating element, said inputs and said output co-act under operating conditions such that, at a sensor signal to said second signal input, said current output supplies a current through a heating element in thermal contact with said shape memory effect material for a period determined by a sensor signal to said first signal input.

25. The release mechanism as recited in claim 1, wherein said release mechanism further comprises structure for locking said rod in said second end position.

* * * * *